US009190234B2

(12) United States Patent
Reuber

(10) Patent No.: US 9,190,234 B2
(45) Date of Patent: Nov. 17, 2015

(54) ELECTROMAGNETIC ACTUATOR, IN PARTICULAR FOR A MEDIUM VOLTAGE SWITCH

(75) Inventor: Christian Reuber, Ratingen (DE)

(73) Assignee: ABB TECHNOLOGY AG, Zürich (CH)

( * ) Notice: Subject to any disclaimer, the term of this patent is extended or adjusted under 35 U.S.C. 154(b) by 1662 days.

(21) Appl. No.: 12/245,489

(22) Filed: Oct. 3, 2008

(65) Prior Publication Data

US 2009/0039989 A1 Feb. 12, 2009

Related U.S. Application Data

(63) Continuation of application No. PCT/EP2007/003039, filed on Apr. 4, 2007.

(30) Foreign Application Priority Data

Apr. 5, 2006 (EP) ..... 06007167

(51) Int. Cl.
*H01H 51/22* (2006.01)
*H01F 7/16* (2006.01)
*H01H 33/666* (2006.01)
(Continued)

(52) U.S. Cl.
CPC ..... *H01H 51/2209* (2013.01); *H01F 7/1646* (2013.01); *H01H 33/666* (2013.01); *H01F 7/081* (2013.01); *H01F 7/088* (2013.01);
(Continued)

(58) Field of Classification Search
USPC ..... 335/151, 153, 154, 219, 220, 229, 230, 335/234, 237, 247, 248, 249, 251, 255, 257, 335/258, 261, 262, 267, 273, 274, 278, 279, 335/281, 282, 284, 296, 297, 302; 310/12.01, 12.02, 14, 15, 17, 23–24, 310/30, 34
See application file for complete search history.

(56) References Cited

U.S. PATENT DOCUMENTS 3,501,724 A * 3/1970 Westphal ..... 335/248
4,093,931 A * 6/1978 Fenton ..... 335/272
(Continued)

FOREIGN PATENT DOCUMENTS

DE 197 51 609 A1 6/1998
DE 20 2004 011 676 U1 1/2005
(Continued)

OTHER PUBLICATIONS

International Preliminary Report on Patentability (Form PCT/IB/373), Written Opinion of the International Search Authority (Form PCT/ISA/237) mailed in corresponding International Patent Application No. PCT/EP2007/003039, Nov. 17, 2008, The International Bureau of WIPO, Geneva, CH.
(Continued)

*Primary Examiner* — Mohamad Musleh
(74) *Attorney, Agent, or Firm* — Buchanan Ingersoll & Rooney PC

(57) ABSTRACT

The disclosure relates to an electromagnetic actuator, such as for a medium-voltage switch, having a core having a coil applied to it, and a movable yoke. A method for producing such an actuator is also disclosed. A compact design can be achieved with, at the same time, a high level of actuator force, using a magnetic circuit of the actuator which has a rectangular magnet core and a round yoke which corresponds to the magnetic circuit of the magnetic core.

21 Claims, 3 Drawing Sheets

(51) Int. Cl.

| | |
|---|---|
| *H01F 7/08* | (2006.01) |
| *H01F 7/122* | (2006.01) |
| *H01H 50/18* | (2006.01) |
| *H01H 50/64* | (2006.01) |

(52) U.S. Cl.

CPC ..... *H01F 7/122* (2013.01); *H01H 33/6662* (2013.01); *H01H 50/18* (2013.01); *H01H 50/641* (2013.01)

(56) References Cited

U.S. PATENT DOCUMENTS

| | | | | |
|---|---|---|---|---|
| 4,470,030 | A * | 9/1984 | Myers | 335/228 |
| 5,903,070 | A | 5/1999 | Göbel | |
| 5,903,204 | A * | 5/1999 | Schmitz et al. | 335/227 |
| 6,763,789 | B1 * | 7/2004 | Liang et al. | 123/90.11 |
| 6,816,048 | B2 * | 11/2004 | Morita et al. | 335/220 |
| 7,044,438 | B2 * | 5/2006 | Feyerl et al. | 251/129.1 |
| 7,124,720 | B2 * | 10/2006 | Liang et al. | 123/90.11 |
| 7,236,071 | B2 * | 6/2007 | Prestini et al. | 335/177 |
| 7,605,680 | B2 * | 10/2009 | Matsumoto et al. | 335/229 |
| 7,946,261 | B2 * | 5/2011 | Sfaxi et al. | 123/90.11 |
| 2006/0082226 | A1 * | 4/2006 | Protze | 310/14 |
| 2007/0171016 | A1 * | 7/2007 | Bonjean et al. | 335/234 |
| 2007/0242408 | A1 * | 10/2007 | Bergstrom et al. | 361/192 |

FOREIGN PATENT DOCUMENTS

| | | | | |
|---|---|---|---|---|
| EP | 1132929 | A1 * | 9/2001 | H01F 7/16 |
| FR | 2 808 375 | A1 | 11/2001 | |
| GB | 726101 | A * | 3/1955 | |
| JP | 2003308761 | A * | 10/2003 | H01H 33/38 |
| WO | WO 01/46968 | A1 | 6/2001 | |
| WO | WO 03030188 | A1 * | 4/2003 | H01F 7/16 |

OTHER PUBLICATIONS

International Search Report (PCT/ISA/210).

European Search Report (EPO Form 1503).

* cited by examiner

ELECTROMAGNETIC ACTUATOR, IN PARTICULAR FOR A MEDIUM VOLTAGE SWITCH

RELATED APPLICATIONS

This application claims priority under 35 U.S.C. §119 to EP Application 06007167.7 filed in Europe on Apr. 5, 2006, and as a continuation application under 35 U.S.C. §120 to PCT/EP2007/003039 filed as an International Application on Apr. 4, 2007 designating the U.S., the entire contents of which are hereby incorporated by reference in their entireties.

TECHNICAL FIELD

The disclosure relates to an electromagnetic actuator which can, for example, be used for a medium-voltage switch, having a core with a coil applied to it, and a movable yoke.

BACKGROUND INFORMATION

Electromagnetic actuators have a wide variety of uses. In addition to the application in medium-voltage switches as controlled actuation of the movable contacts, such actuators can also be used in machines and in switches.

Single-coil and two-coil electromagnets constitute prior art in terms of the electromagnetic drive for medium-voltage vacuum circuit breakers. As has already been mentioned above, the electromagnetic has the function of moving the movable contact of the vacuum chamber towards the fixed contact in the event of a connection and of tensioning a contact pressure spring with an excess stroke.

In order to start the movement, a current is passed through the coil of the electromagnet. The connected position is then held, counter to the force of the contact pressure spring, with the aid of one or more permanent magnets. Current in the coil used as the connection coil is then no longer required.

In order to disconnect the switch, in the case of a two-coil actuator, a current is passed through a disconnection coil which initially weakens the holding force of the permanent magnets to such an extent that the contact pressure spring can no longer be held and the movable contact opens. As the disconnection movement continues, an opening force can be produced by the disconnection coil.

In the case of a single-coil electromagnet, the disconnection can essentially only be initiated by the coil. The continuation of the disconnection is then determined by the contact pressure spring and by a separate disconnection spring.

Existing single-coil actuators are often of rotationally symmetrical design. This can prevent them from being matched in a simple manner to another rated short-circuit current since another diameter needs to be selected for a change in the air gap area. All parts can therefore in each case only be used for one size.

SUMMARY

Exemplary embodiments disclosed herein are directed to an electromagnetic actuator which can, for example, be used in a medium-voltage switch, to such an extent that a compact design can be achieved with, at the same time, a high level of actuator force.

An electromagnetic actuator is disclosed which comprises: a magnet core having a coil; and a movable yoke, wherein the magnet core of the electromagnetic actuator is rectangular and the movable yoke is a round yoke which corresponds to the magnetic circuit of the magnet core.

A method is also disclosed for producing an electromagnetic actuator, comprising: a magnet core having a coil; and a movable yoke, wherein the magnet core of the electromagnetic actuator is rectangular and the movable yoke is a round yoke which corresponds to a magnetic circuit of the magnetic core; the method comprising: mass producing a plurality of different actuators by varying a depth of the rectangular magnet core and a diameter of the round yoke.

The disclosure is illustrated in the drawing and will be explained in more detail below.

Figure 1:
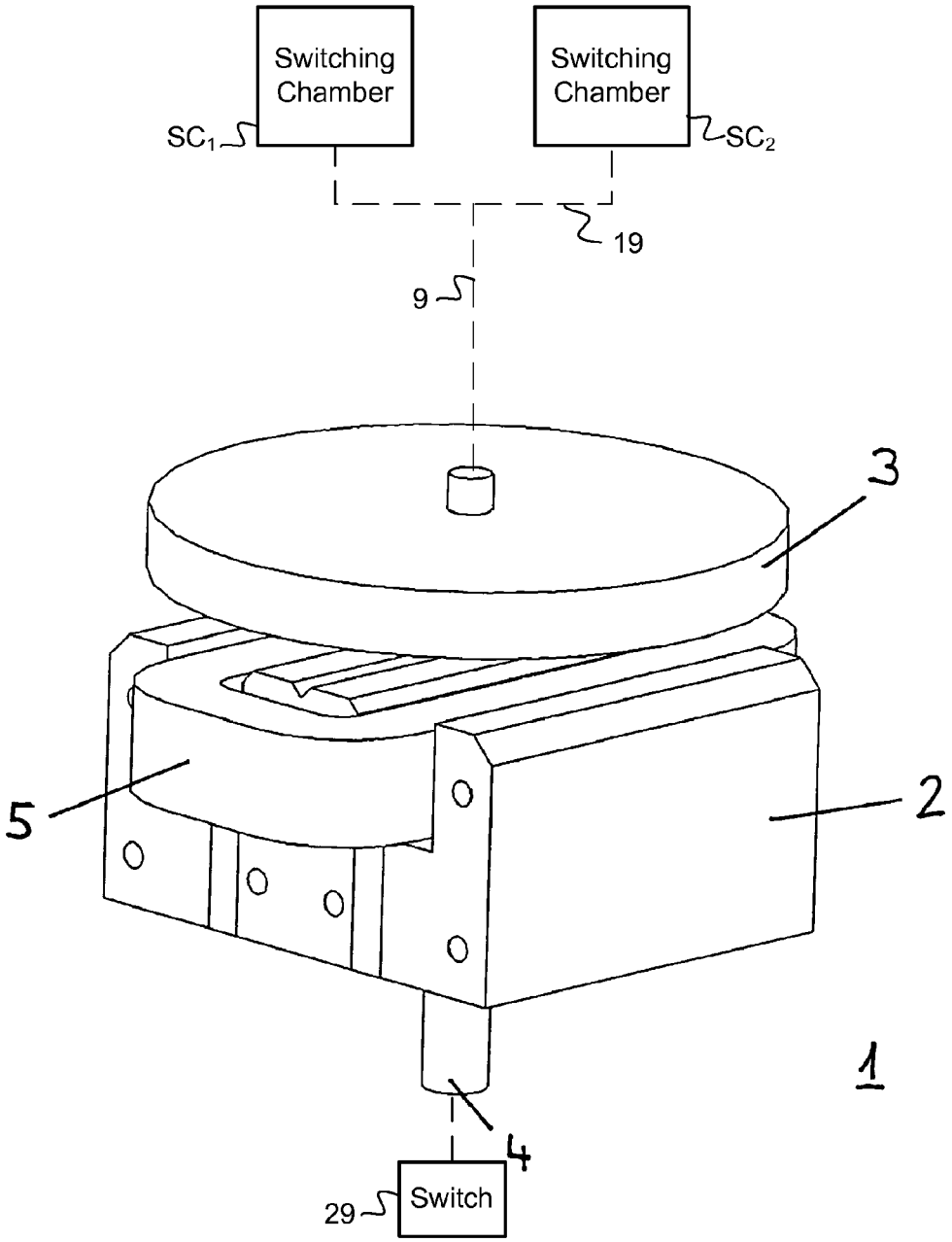
FIG. 1 shows a perspective view of an exemplary magnetic actuator having a round yoke.

According to exemplary embodiments disclosed herein, a rectangular core of an electromagnetic actuator is combined with a round, i.e. rotationally symmetrical, yoke. The round yoke can be selected to correspond to the magnetic circuit (i.e., to achieve the functional relationship between the magnetic core and the yoke as described herein).

An exemplary advantage over a rectangular yoke is that the rotationally symmetrical yoke does not need to be secured against rotation—it fulfils its function in the same manner in any position. This can be particularly significant when used in medium-voltage switches.

This configuration results in a combination of a magnet core which can be rectangular and have a fixed width and a variable depth. Since the core can comprise layered laminates, the number of laminates can be used to adjust the depth. Lateral attachments, bearings and shafts can be adopted. In such embodiments, merely the permanent magnets and the coil formers need to be matched to the size of the core by a length variation.

In comparison to a two-coil actuator, the present disclosure—as well as existing single-coil actuators—can have the advantages of a reduced size and a reduced weight. This is essentially due, for example, to the fact that only one coil and only one magnetic circuit are required. In comparison to existing single-coil actuators, the present disclosure makes it possible for the magnet size to be matched in a simple manner to the rated short-circuit currents, which are to be controlled by medium-voltage circuit breakers, with a pattern of 12.5-16-20-25-31.5-40 and 50 kA. In this case, it is desirable to change the holding force of the actuator by changing the air gap area.

Another advantage according to exemplary embodiments of the disclosure is that the yoke can be rotated on the shaft in a thread in order to be able to continuously adjust the stroke of the magnetic actuator. This also makes use of the advantage of using an individual actuator for a large number of applications which differ from one another by having a different switching stroke.

A particularly compact device can be realized if, for example, the drive is arranged directly beneath the switching pole of a switch (e.g., a medium voltage switch) to be driven, whilst dispensing with levers and deflections. The direct coupling favours the quality of the path/time characteristic of the drive which in this case can be free from interfering influences of spring constants and play of a more complicated drive system.

However, it is also possible for the drive to be required to be matched to existing structures. In this case, it is also possible to connect a magnetic actuator to a plurality of switching poles to be driven via, for example, a lever system and for these switching poles thus to be driven at the same time. The advantages in this case lie in the possibility of being able to influence the force and stroke in a targeted manner by the lever ratio.

Also characteristic of exemplary embodiments of the present disclosure is the use of a high force density. Given a predetermined physical space, in particular given a limited area at the magnetic air gap, very high magnetic forces can be achieved by 1) the area of the permanent magnets not being limited by the predetermined area of the air gap; and by
2) the magnetic flux being further concentrated directly at the air gap.

Another advantageous refinement uses an actuator 1 that is placed directly under the vacuum switching chamber (SC) of a medium-voltage switch such that it is free from leverage and from deflection and acts directly on the contact rod.

This can ensure effective and rapid action of forces.

Another advantageous refinement uses an actuator 1 that switches a plurality of switching chambers ($SC_n$), at the same time via coupling elements (19).

Furthermore, exemplary embodiments can include an actuator 1 that drives the switching chamber or the switching chambers ($SC_n$), via lever elements 9. This is not necessary with certain switch designs. This is also easily possible owing to high actuating forces which can be advantageously achieved using exemplary embodiments disclosed herein.

Another advantageous refinement specifies that the stroke of the actuator can be changed by changing the geometrical design of the yoke on the actuating shaft.

Another advantageous refinement specifies that permanent magnets are introduced in the magnet core which have a direction of magnetization which is as parallel to the plane of the air gap as possible.

In this case, the magnetic circuit is matched in design terms such that there is a magnetic induction of, for example, more than 2 Tesla in the air gap.

Another advantageous refinement specifies that the yoke is fixed on an actuating shaft, which runs on one side centrally through the magnet core in a displaceable manner and is connected on the other side to the contact actuating rod to be switched. This can result in a design which can achieve compact and direct articulation for the purpose of actuating the contact pieces.

Another exemplary refinement includes a side of the actuating shaft which runs through the magnet core protruding out of the magnet core at the lower end and being connected there to a second yoke having a smaller lateral dimension, such that a holding force can be produced in the disconnected position.

Owing to the exemplary design proposed in a refinement, in which the lower yoke and the upper yoke are arranged on the actuating shaft such that they are spaced apart from one another in a fixed relative position and such that, if the upper yoke lifts off from the magnet core with the desired stroke, the lower yoke bears against the magnet core from below, virtual locking of the disconnected position of the contact piece can be achieved.

In order overall to damp the movement in the limit stop, a damping base can be arranged between the lower yoke and the underside of the magnet core.

At least one spring can be provided so as to act on the actuating shaft in order to assist in the disconnection, it being possible for this spring to be, for example, a leaf spring or other suitable device.

Owing to the fact that the magnet core comprises iron laminates, the eddy currents induced by changes in the flux can be reduced to a sufficient extent. It is even possible to dispense with the addition of silicon in the iron.

Overall, a method is also specified for producing a plurality of different electromagnetic actuators of the design disclosed herein, the actuators being mass-produced by merely the depth of the rectangular magnet core and the diameter of the round yoke being varied. This can result in a simple series manufacturing process, even when taking different sizes into consideration.

FIG. 1 shows a perspective view of an exemplary electromagnetic actuator, having an electromagnet 1 having a coil 5, a rectangular magnet core 2 and a round yoke 3. In this case, the yoke 3 is fixed to an actuating shaft 4, which runs centrally through the magnet core 2 such that it can move axially.

Figure 2:
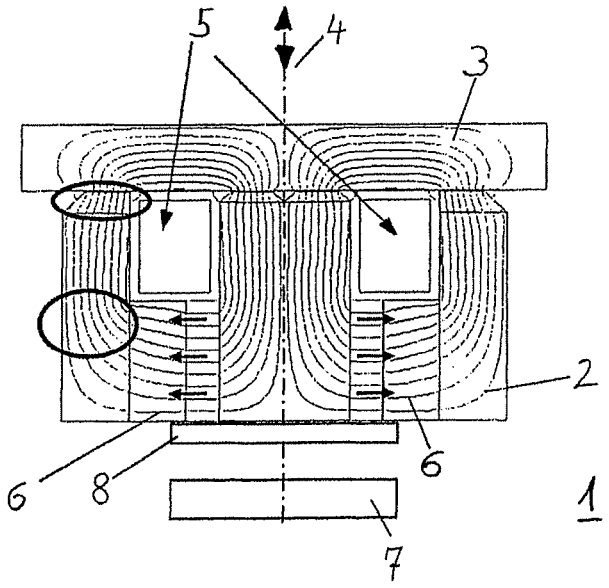
FIG. 2 shows an illustration of exemplary lines of force.
Figure 3:
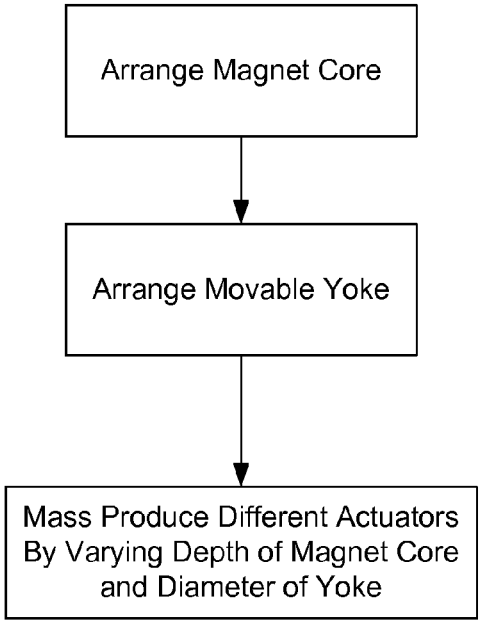
FIG. 3 shows a method for producing an electromagnetic actuator.

FIG. 2 shows an illustration of the lines of force of this exemplary electromagnetic actuator. The magnet core 2 shows the course of the lines of force when the system is closed, i.e. when the round yoke 3 bears on the magnet core 2. Integrated within the magnet core are permanent magnets 6, whose direction of magnetization is substantially parallel to the air gap plane (e.g., as close to parallel as possible).

In this case, the actuating shaft is not illustrated, but the round yoke 3 and the lower smaller yoke 7 are held on it in this functional manner such that they are spaced apart from one another, as has already been described above. A damping base 8 can be arranged between the small yoke 7 and the magnet core 2.

The actuator can therefore be arranged within a switching device.

The actuating shaft 4 of the actuator is in this case connected to the movable contact of a vacuum switching chamber and acts on this vacuum switching chamber in a corresponding manner so as to bring about switching actuation. This connection may also be articulated in, for example, a straight line via levers.

Overall, the following relationships can also result.

The permanent magnet materials which are technically available and have a high magnetic energy (for example NdFeB, SmCo) have remanent inductions in the range from 1 to 1.4 T. This is considerably less than can be passed in the iron core with reasonable magnetic losses. The permanent magnets have therefore been introduced according to the exemplary embodiments of disclosure with a horizontal polarity.

If the flux then changes in the limb to the horizontal direction, it is concentrated there. Given a predetermined width of the limb, a greater flux can thus be produced than in the case of an arrangement of the permanent magnets in the limb and with a vertical polarization.

A further concentration of the magnetic flux takes place at the transition from the limb to the yoke via the air gap. In order to maximize the holding force, the present magnetic actuator can be designed such that a magnetic induction of over 2 T is achieved.

If the permanent magnets, as shown here, are introduced such that their ends are visible on the underside of the magnet and, moreover, form a smooth surface with the lower ends of the iron core, a second, smaller yoke can then produce a second, smaller holding force in the disconnected position of the magnet. This serves to lock the disconnected position of the movable contact of the vacuum chamber, which is therefore protected against being connected in an undesirable manner, for example by vibrations.

A damping base can be inserted between the core of the magnetic actuator and the second yoke, and this damping base can damp the action of the second yoke impinging mechanically on the core in the event of a disconnection. This both serves to avoid oscillations when the second yoke impinges on the core and results in a longer life of the entire switching device.

Iron laminates having a low silicon content are used in this case for the magnet core in order to reduce eddy currents induced by changes in the flux. The use of silicon, however, can reduce the magnetic polarizability of the material. In order to achieve very high forces, iron laminates without any addition of silicon can, for example, be used for the present magnetic actuator.

If it is desired to vary the depth of the magnetic core in order to realize different strengths of the magnet, as described above, the disconnection spring should not be placed in the centre of the magnet, since this would interfere with the magnetic symmetry, which can only be compensated for for one size. Instead, in exemplary embodiments, provision is made for the disconnection spring to be placed outside the magnet.

In addition, a leaf spring 29 is proposed which is fixed beneath the actuator and is supported laterally on the housing of the switching device. In this case, advantages include—in addition to a very simple design—a low number of parts, low costs and the possibility of being able to adjust the spring force by adjusting the width of a compression plate.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An electromagnetic actuator comprising:

a magnet core having a coil;

a movable yoke; and an actuating shaft extending through the movable yoke and the magnet core, wherein:

the magnet core of the electromagnetic actuator is rectangular, the movable yoke is a round yoke which corresponds to a magnetic circuit of the magnet core, the movable yoke has a first surface extending in a first direction and configured to contact a first surface of the magnet core extending in the first direction, a second surface extending in the first direction, and a third surface extending in a second direction orthogonal to the first direction between the first and second surfaces of the movable yoke, the actuating shaft extends in the second direction, the actuating shaft having a first end which extends beyond the second surface of the movable yoke and a second end which extends through a second surface of the magnet core extending in the first direction, the first surface of the magnet core being opposite to the second surface of the magnet core, the movable yoke is rotatable about the actuating shaft perpendicular to the second direction, a second yoke is arranged at the second end of the actuating shaft, the second yoke having first and second surfaces extending in the first direction, and a third surface extending in the second direction between the first and second surfaces of the movable yoke, and the first and second surfaces of the second yoke having a smaller length than the first and second surfaces of the movable yoke.

2. The electromagnetic actuator according to claim 1, in combination with a vacuum switching chamber of a medium voltage switch having a contact rod, wherein the electromagnetic actuator is placed directly under the vacuum switching chamber such that the electromagnetic actuator is free from leverage and from deflection, and acts directly on the contact rod of the medium voltage switch.

3. The electromagnetic actuator according to claim 2, wherein the electromagnetic actuator is configured to switch a plurality of switching chambers at a same time via coupling elements.

4. The electromagnetic actuator according to claim 2, wherein the electromagnetic actuator comprises a lever element, and the electromagnetic actuator is configured to drive the switching chamber via the lever element.

5. The electromagnetic actuator according to claim 1, wherein a displaced arrangement of the movable yoke on the actuating shaft is configured to change a stroke of the electromagnetic actuator.

6. The electromagnetic actuator according to claim 1, comprising:

permanent magnets in the magnet core, the permanent magnets having a direction of magnetization which is substantially parallel to a plane of an air gap.

7. The electromagnetic actuator according to claim 1, wherein the magnetic circuit is configured to produce a magnetic induction of more than 2 Tesla in an air gap.

8. The electromagnetic actuator according to claim 7, wherein the movable yoke is fixed on the actuating shaft, the actuating shaft running on one side of the magnet core centrally through the magnet core in a displaceable manner and being connected on another side of the magnet core to a contact actuating rod to be switched.

9. The electromagnetic actuator according to claim 8, wherein the electromagnetic actuator is configured to switch a plurality of switching chambers at a same time via coupling elements.

10. The electromagnetic actuator according to claim 9, wherein the electromagnetic actuator comprises lever elements, and the electromagnetic actuator is configured to drive the switching chambers via lever elements.

11. The electromagnetic actuator according to claim 10, comprising:

at least one spring to act on the actuating shaft to assist in disconnection of a switch.

12. The electromagnetic actuator according to claim 11, wherein the magnet core comprises iron laminates which do not contain silicon.

13. The electromagnetic actuator according to claim 1, wherein the movable yoke is fixed on the actuating shaft, the actuating shaft running on one side of the magnet core centrally through the magnet core in a displaceable manner for connection on another side of the magnet core to a contact actuating rod to be switched.

14. The electromagnetic actuator according to claim 1, wherein the round yoke and the second yoke are arranged on the actuating shaft such that they are spaced apart from one another in a fixed relative position and such that, if the round yoke lifts off from the magnet core with a desired stroke of the electromagnetic actuator, the second yoke bears against the magnet core from below.

15. The electromagnetic actuator according to claim 14, comprising:

a damping base arranged between the second yoke and the second surface of the magnet core facing the lower yoke.

16. The electromagnetic actuator according to claim 1, comprising:

at least one spring configured to act on the actuating shaft to assist in disconnection of a switch.

17. The electromagnetic actuator according to claim 16, wherein the spring is a leaf spring.

18. The electromagnetic actuator according to claim 1, wherein the magnet core comprises iron laminates which do not contain silicon.

19. The electromagnetic actuator according to claim 1, wherein the movable yoke is a monolithic structure, wherein the lengths of the first and second surfaces of the movable yoke extending in the first direction are greater than the length of the third surface of the movable yoke extending in the second direction, wherein the actuating shaft extends through the third surface of the movable yoke between the first and second surfaces of the movable yoke, and wherein the second surface of the movable yoke has a uniformly flat surface.

20. A method for producing an electromagnetic actuator, the method comprising:

arranging a rectangular magnet core having a coil;

arranging a movable yoke which is round and which corresponds to a magnetic circuit of the magnetic core, the movable yoke having a first surface extending in a first direction and configured to contact the magnet core, a second surface extending in the first direction, a third surface extending in a second direction orthogonal to the first direction between the first and second surfaces of the movable yoke;

arranging an actuating shaft to extend through the movable yoke and the magnet core, the actuating shaft extending in the second direction, the actuating shaft having a first end which extends beyond the second surface of the movable yoke and a second end which extends through a second surface of the magnet core extending in the first direction, the first surface of the magnet core being opposite to the second surface of the magnet core, the movable yoke and the actuating shaft being arranged such that the movable yoke is rotatable about the actuating shaft perpendicular to the second direction;

arranging a second yoke at the second end of the actuating shaft, the second yoke having first and second surfaces extending in the first direction, and a third surface extending in the second direction between the first and second surfaces of the movable yoke, the first and second surfaces of the second yoke having a smaller length than the first and second surfaces of the movable yoke; and mass producing a plurality of different actuators by varying a depth of the rectangular magnet core and a diameter of the round yoke.

21. The method according to claim 20, wherein the movable yoke is a monolithic structure, wherein the lengths of the first and second surfaces of the movable yoke extending in the first direction are greater than the length of the third surface of the movable yoke extending in the second direction, wherein the actuating shaft extends through the third surface of the movable yoke between the first and second surfaces of the movable yoke, and wherein the second surface of the movable yoke has a uniformly flat surface.

* * * * *